US005247719A

United States Patent [19]

Wareham et al.

[11] Patent Number: 5,247,719

[45] Date of Patent: Sep. 28, 1993

[54] VACUUM CLEANER TOOL STORAGE

[75] Inventors: Richard A. Wareham, North Canton; Robert C. Shorthill; Edgar A. Maurer, both Canton, all of Ohio

[73] Assignee: The Hoover Company, North Canton, Ohio

[21] Appl. No.: 885,930

[22] Filed: May 18, 1992

Related U.S. Application Data

[63] Continuation of Ser. No. 632,917, Dec. 24, 1990, abandoned.

[51] Int. Cl.[5] ..... A47L 9/00

[52] U.S. Cl. ..... 15/323; 15/331; 15/351

[58] Field of Search ..... 15/323, 331

[56] References Cited

U.S. PATENT DOCUMENTS

| | | | |
|---|---|---|---|
| 2,867,833 | 1/1959 | Duff | 15/323 |
| 3,217,350 | 11/1965 | Waters et al. | 15/323 |
| 4,364,146 | 12/1982 | Bowerman | 15/323 |
| 4,452,618 | 6/1984 | Kuplas | 15/323 X |
| 4,554,700 | 11/1985 | Lyman | 15/323 |

OTHER PUBLICATIONS

Panasonic Vaccum Cleaner Model MC-E41.

*Primary Examiner*—Chris K. Moore

[57] ABSTRACT

A tool storage arrangement is provided for a hard bag upright cleaner by forming a covered compartment in the hard bag portion and tool mounting means in the compartment.

10 Claims, 8 Drawing Sheets

FIG.-1
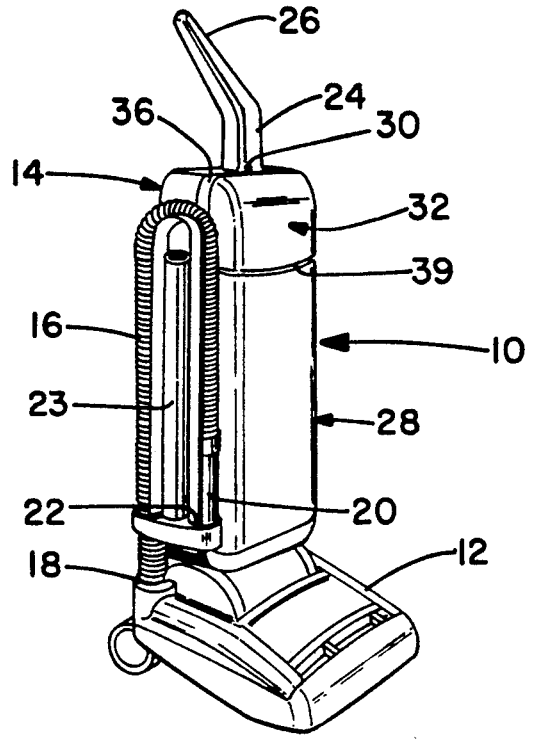
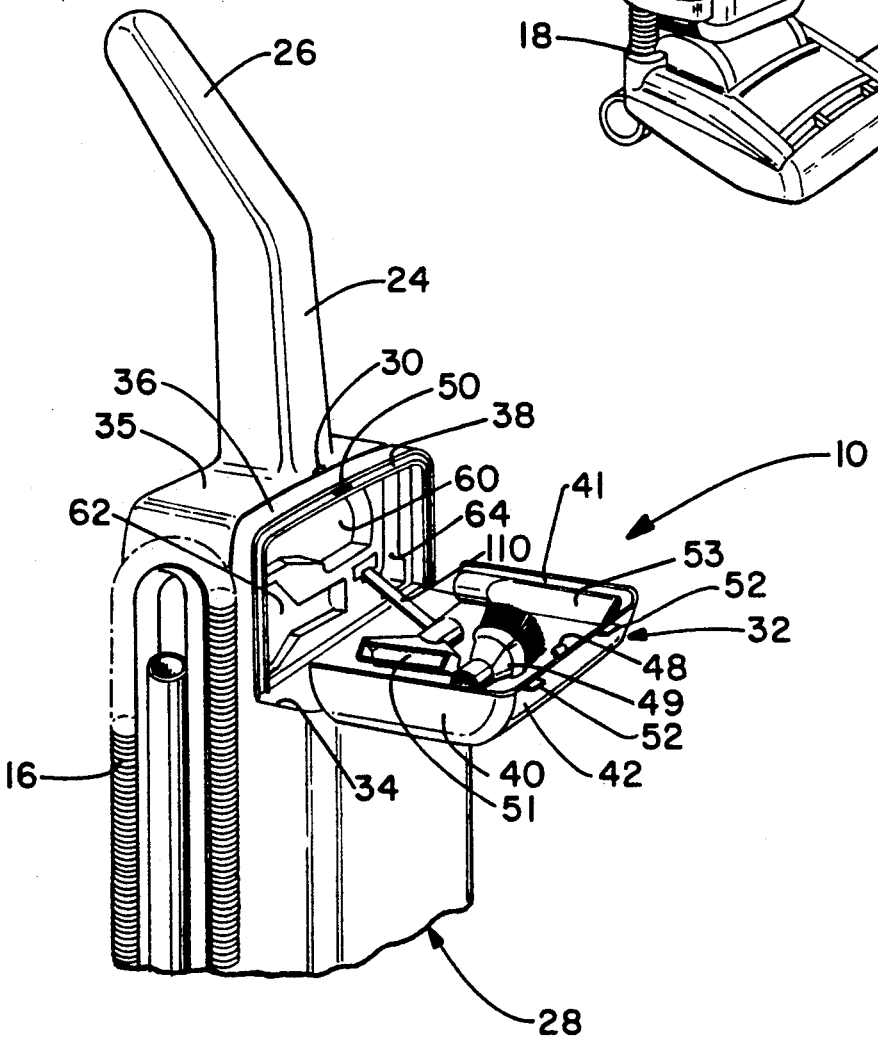
FIG.-2

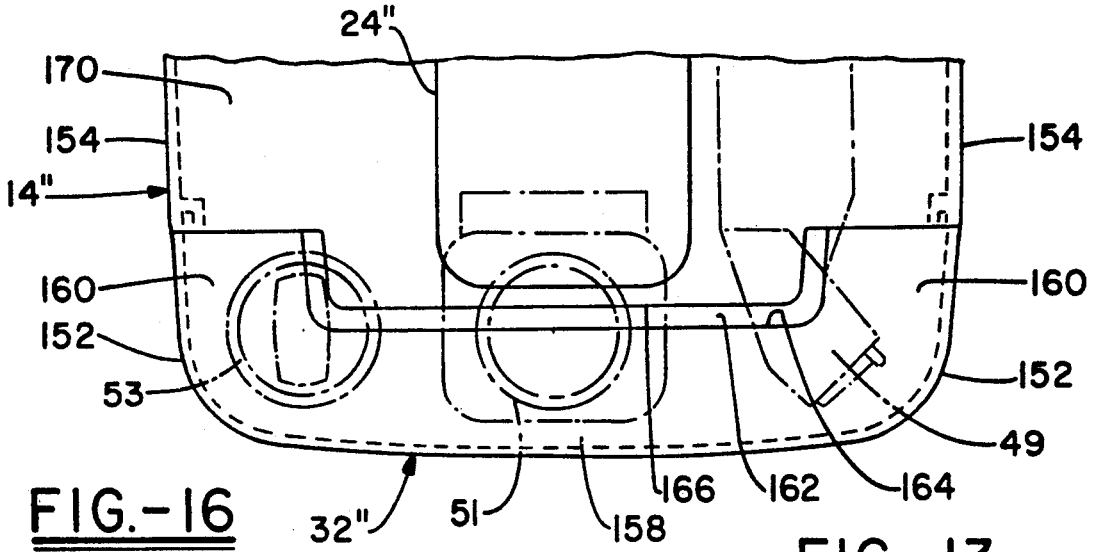
FIG.-16
FIG.-13
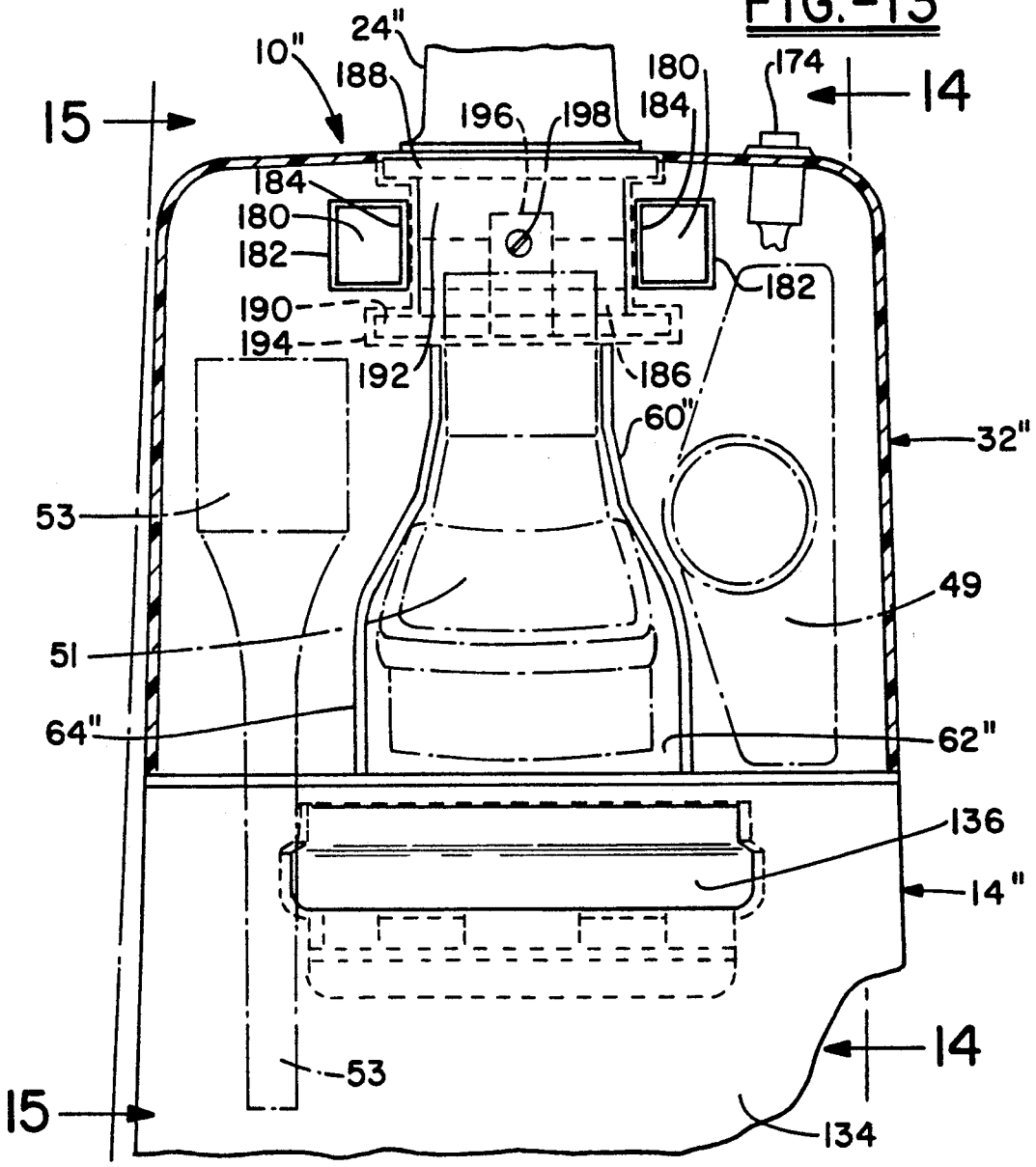

VACUUM CLEANER TOOL STORAGE

This is a continuation of application Ser. No. 07/632,917 filed Dec. 24, 1990, now abandoned.

BACKGROUND OF THE INVENTION

1. Field of the Invention

This invention relates to vacuum cleaners and, more particularly, relates to the use of internal tool storage with an upright cleaner.

2. Summary of the Prior Art

The use of internal tool storage arrangements with vacuum cleaners such as canister cleaners is old and well known. At the present time, more and more upright cleaners are being provided with, not only a conversion arrangement for alternate hose use, but also hose conversion arrangements, mounted with the upright cleaner, which are extremely simple and facile for operator use. Accordingly, since cleaning tools are normally utilized for hose operation, convenient mounting of them similarly with the upright cleaner would be also desirable.

It is, therefore, an object of the invention to conveniently mount cleaning tools with an upright cleaner, easily accessible to the user of the upright cleaner.

It is an additional object of the invention to mount cleaning tools on an upright cleaner in its upper portion.

It is a further object of the invention to mount cleaning tools in a rigid housing furnished with an upright cleaner.

It is a still further object of the invention to provide for tool storage in a part of a hard bag portion of an upright cleaner.

It is an even further object of the invention to mount the cleaning tools internally relative the hard bag portion of an upright cleaner.

It is also an object of the invention to provide an improved cleaning tool mounting arrangement for an upright cleaner.

SUMMARY OF THE INVENTION

An upright cleaner is provided, conventionally, having a suction nozzle pivotally attached to a handle through a hard bag or the like. The hard bag provides a volume for the insertion of a dirt collecting bag (not shown), egress to which is had by a swinging bag door that is latched in closed position relative to the remainder of the hard bag.

An internal tool storage arrangement, including storage for a crevice tool, dusting brush and furniture nozzle, is situated in an upper portion of the upright cleaner by being located at the upper end of the hard bag, closely adjacent the vacuum cleaner operator and the hand grip portion of the handle of the cleaner.

Shaped wells are provided in the internal tool storage arrangement with partially receive the tools in an inserted abutting relation while deformable ribs, adjacent the wells, wedgingly maintain the tools in a mounted condition. The cleaning tools of the invention are received in a tool storage specific array to limit requisite space requirements within the cleaner.

In the first embodiment of the upright cleaner, the tool storage arrangement is disposed in a tool compartment door. In the second and third embodiments of the invention, the tool storage arrangement is disposed in a compartment formed in the hard bag behind the tool storage door. In all three embodiments, the tool compartment door, because tool storage is desired in upper reaches of the hard bag, includes an upper side that forms a portion of the top surface of the hard bag and in the third and preferred embodiment of the invention, at least one of the tools is nested in space conserving, overlapping relationship with the inwardly jutting handle and its mounting structure in the hard bag.

BRIEF DESCRIPTION OF THE DRAWINGS

Reference now may be had to the accompanying Drawings for a better understanding of the invention, both as to its organization and function, with the illustration showing several embodiments, but being only exemplary, and in which:

FIG. 1 is a perspective view of the front of an exemplary hard bag cleaner which utilizes the first embodiment of the invention;

FIG. 2 is a similar, slightly enlarged view of upper portions of this cleaner with the tool compartment door open;

FIG. 13 is an elevational view of the upper portions of a hard bag cleaner of the preferred embodiment of the invention showing the tool compartment, tool door and stored tools;

FIG. 16 is a top plan view of the structure of FIG. 13 but showing the tool door in closed position.

DETAILED DESCRIPTION OF THE INVENTION

Figure 5:
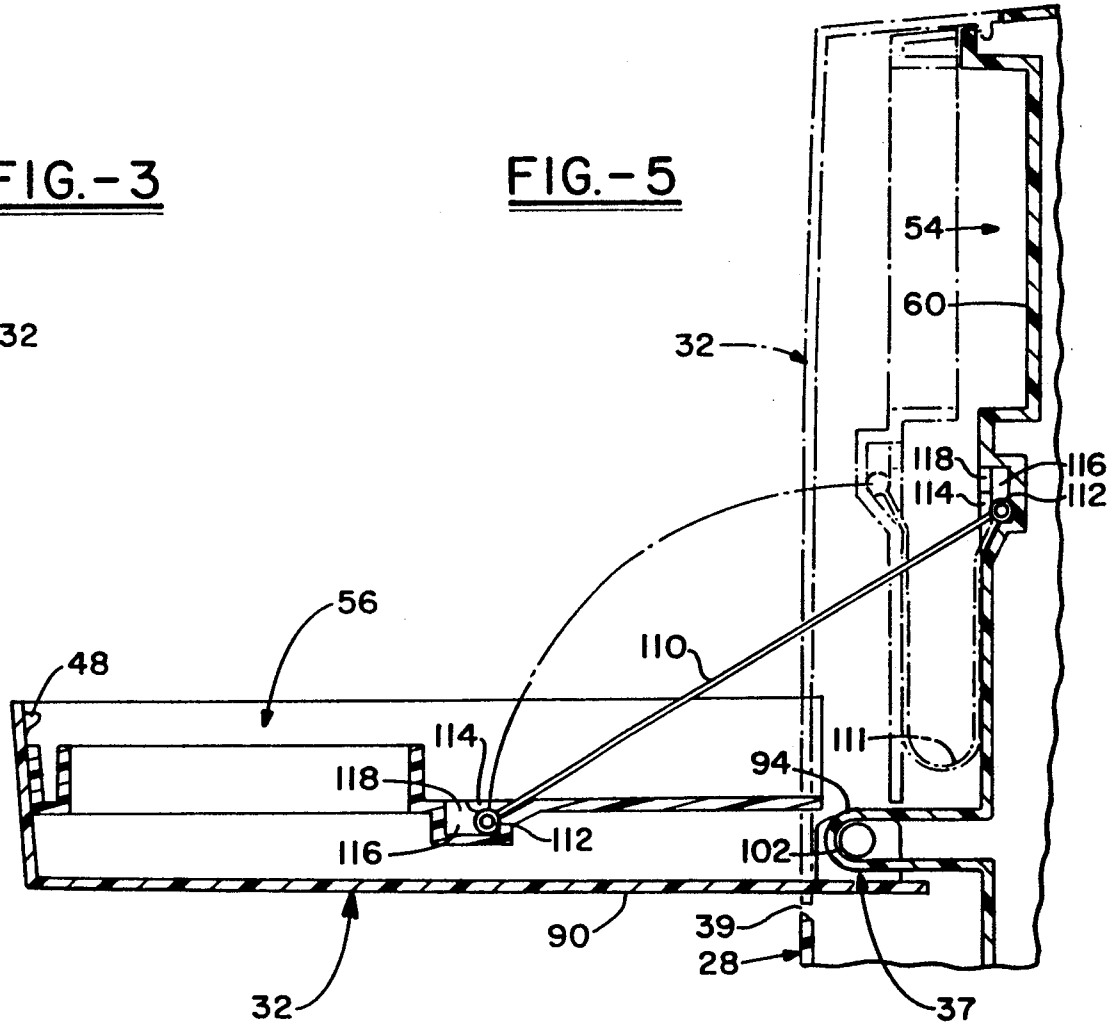
FIG. 5 is a cross sectional elevational view of the tool compartment without tools and the tool door open taken on line 5—5 of FIG. 4.
Figure 3:
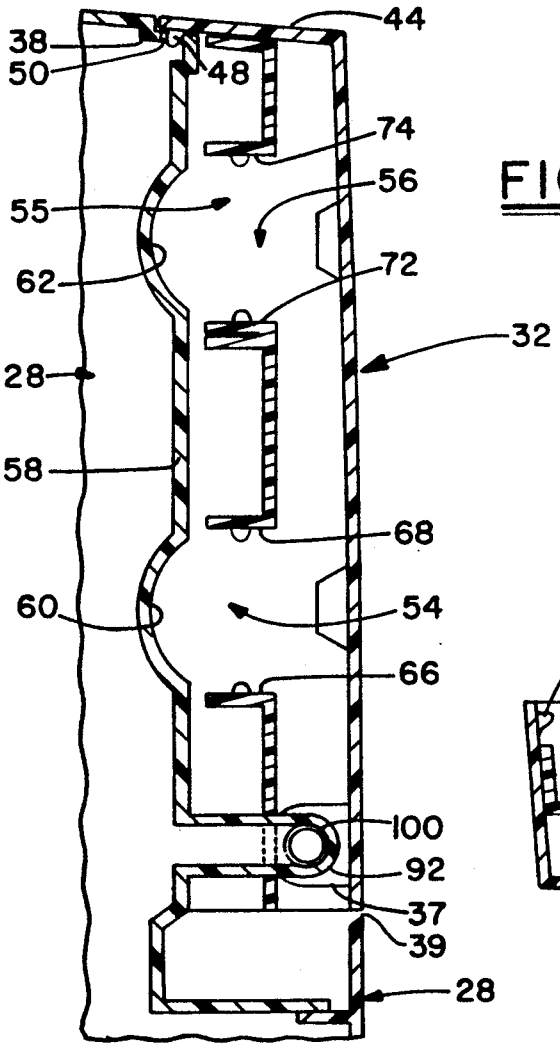
FIG. 3 is an elevational cross sectional view of the door mounted tool storing arrangement of the first embodiment of the invention and taken on line 3—3 of FIG. 4.
Figure 4:
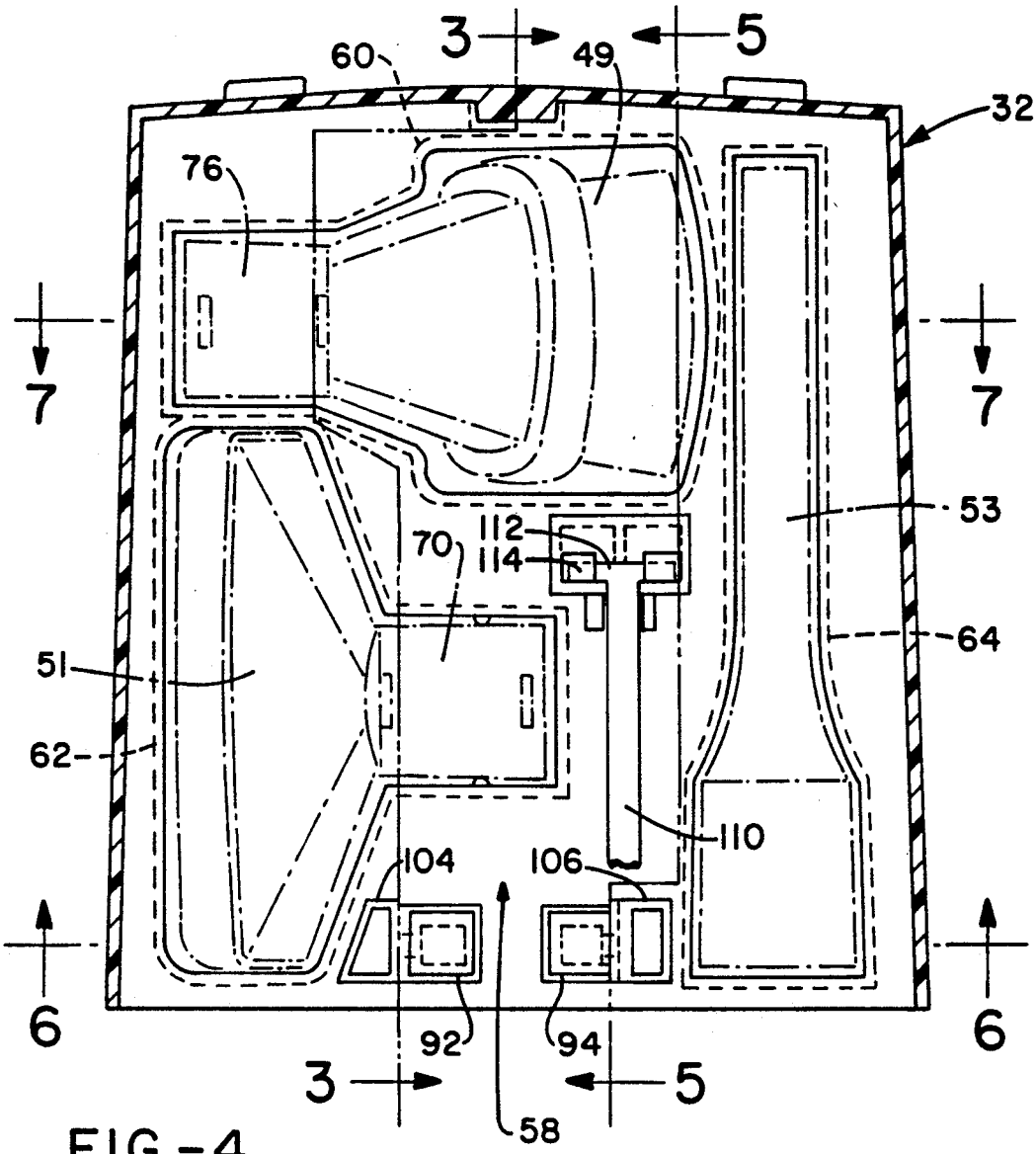
FIG. 4 is an elevational cross sectional view through the closed tool door showing its tool compartment and the stored tools.
Figure 6:
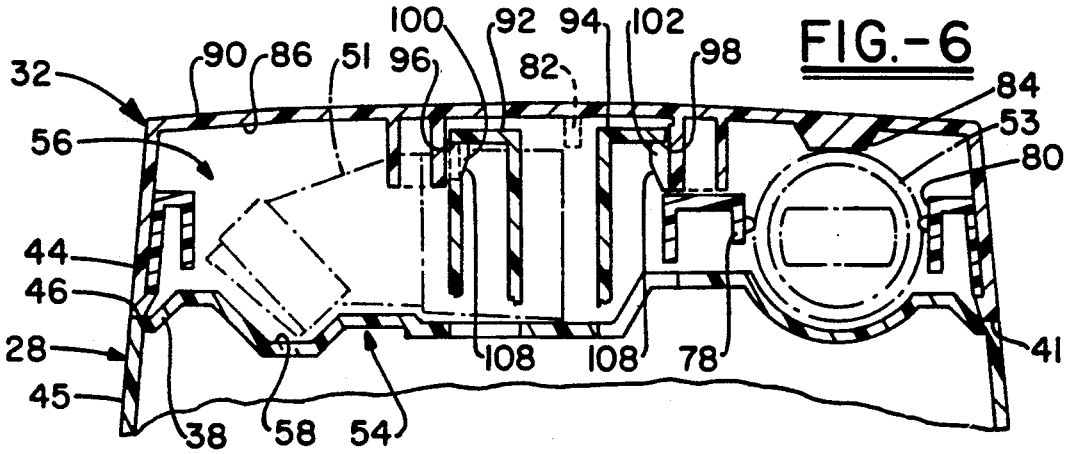
FIG. 6 is a cross sectional plan view like FIG. 5 but taken on line 6—6 of FIG. 4.
Figure 7:
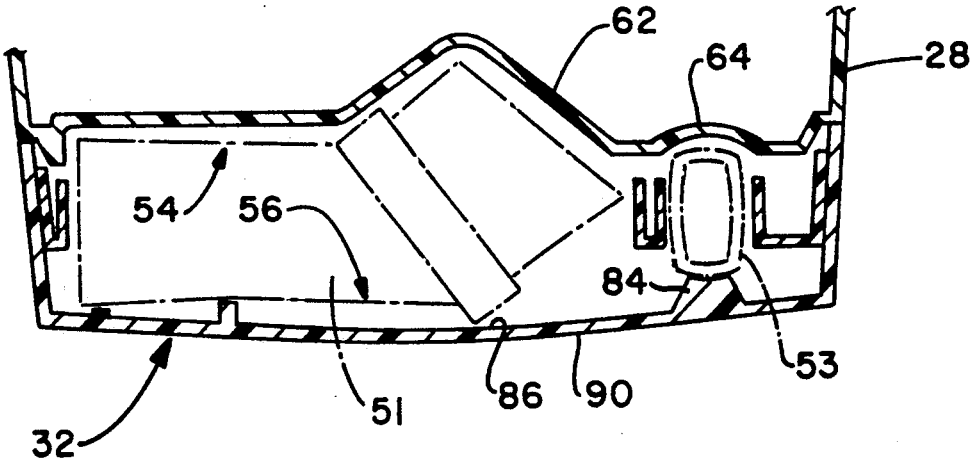
FIG. 7 is a similar cross section plan view of the first embodiment of the invention, taken on line 7—7 of FIG. 4.
Figure 8:
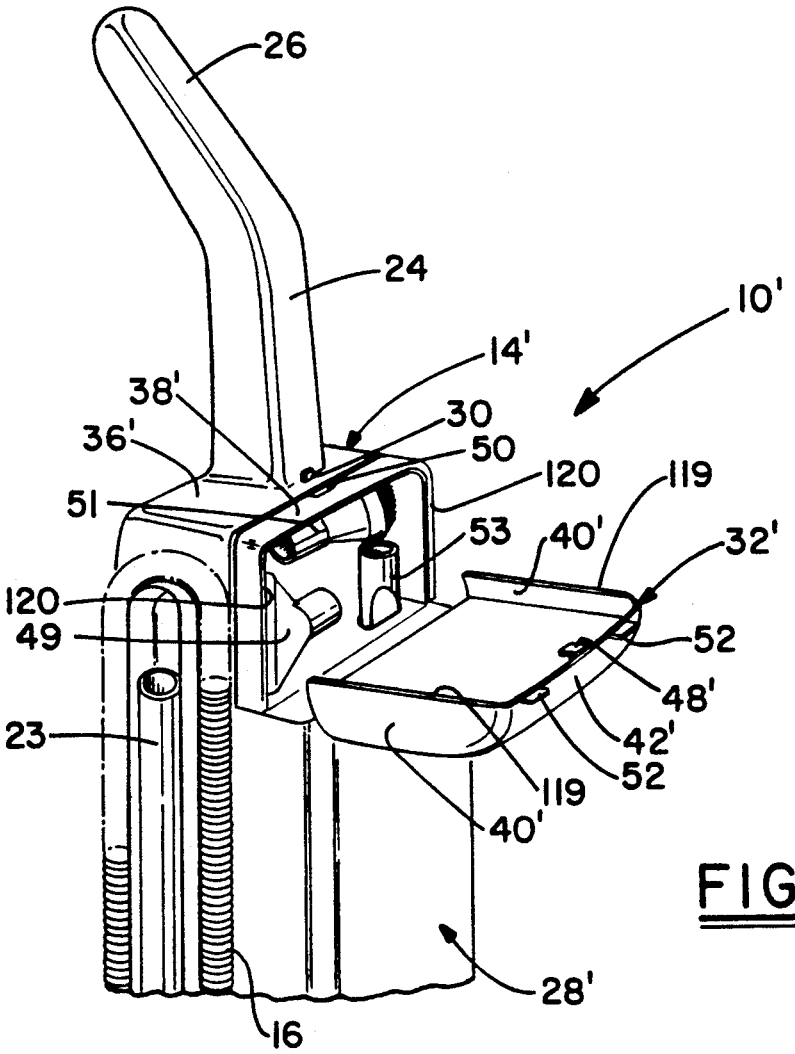
FIG. 8 is a perspective view of the second embodiment of the invention incorporated into a cleaner, with only the upper portion of the cleaner depicted.
Figure 9:
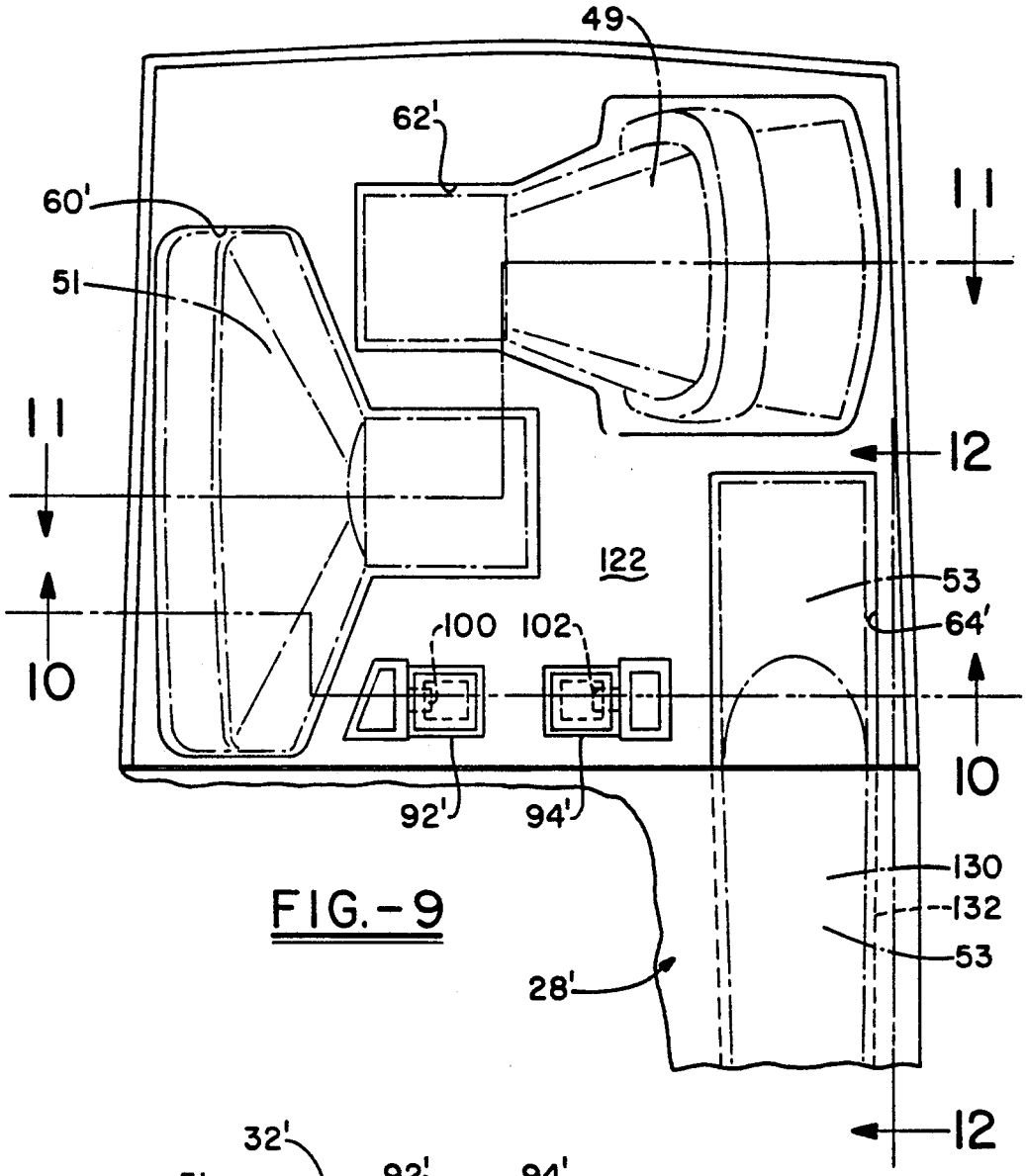
FIG. 9 is an elevational view of the second embodiment of the invention showing the tool compartment with its door closed and the stored tools.
Figure 10:
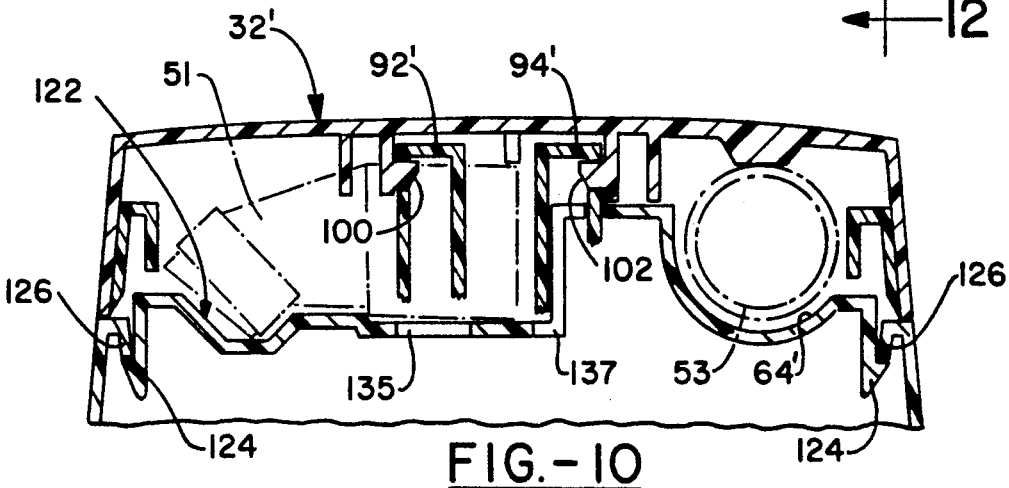
FIG. 10 is a cross sectional plan view of the tool compartment and its closed door taken on line 10—10 of FIG. 9.
Figure 11:
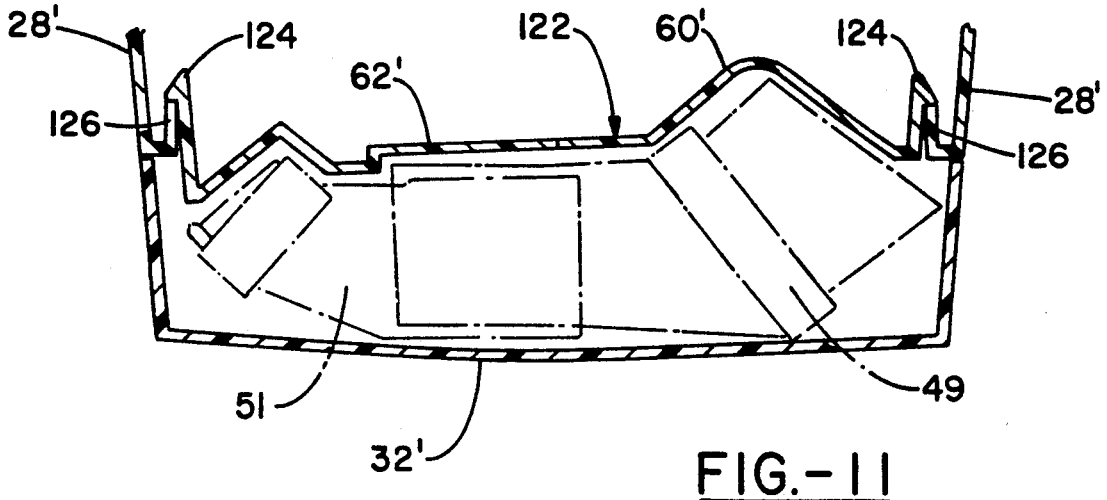
FIG. 11 is a cross sectional plan view of FIG. 9 taken on line 11—11 of FIG. 9.
Figure 12:
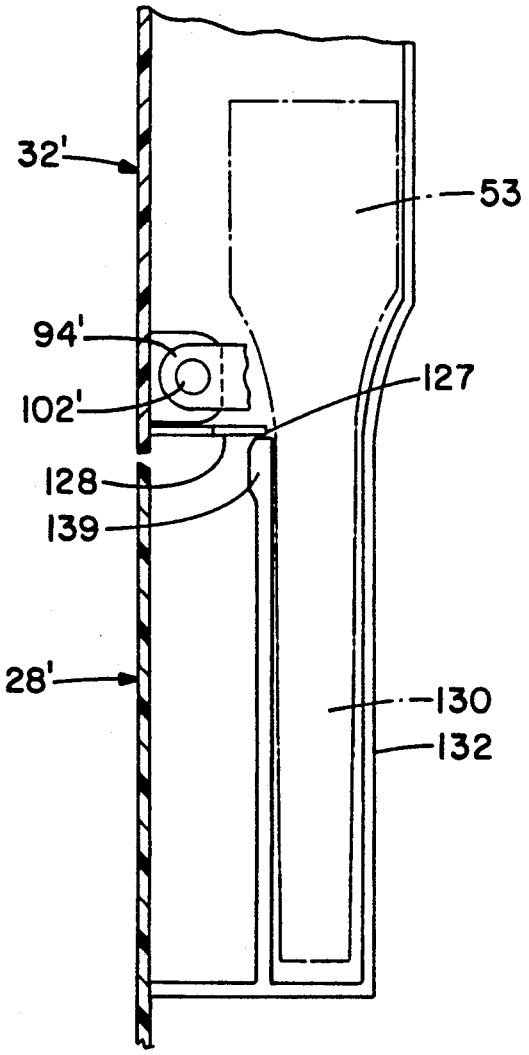
FIG. 12 is a fragmentary elevational view of FIG. 9 taken on line 12—12.
Figure 14:
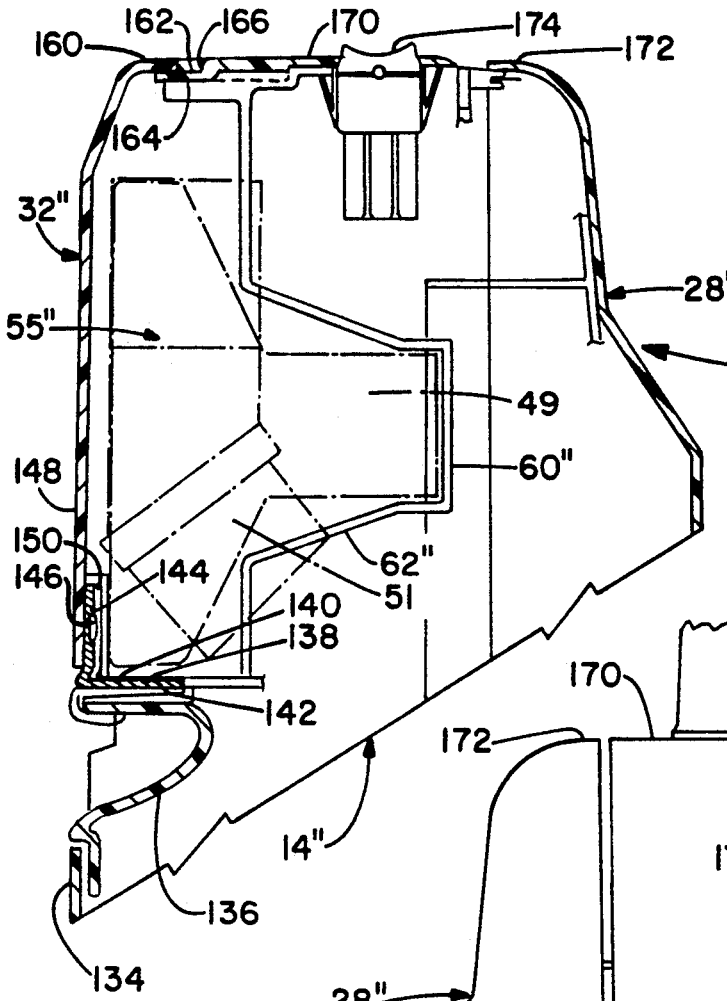
FIG. 14 is a sectional elevational view of this embodiment taken on line 14—14 of FIG. 13 with certain parts removed.
Figure 15:
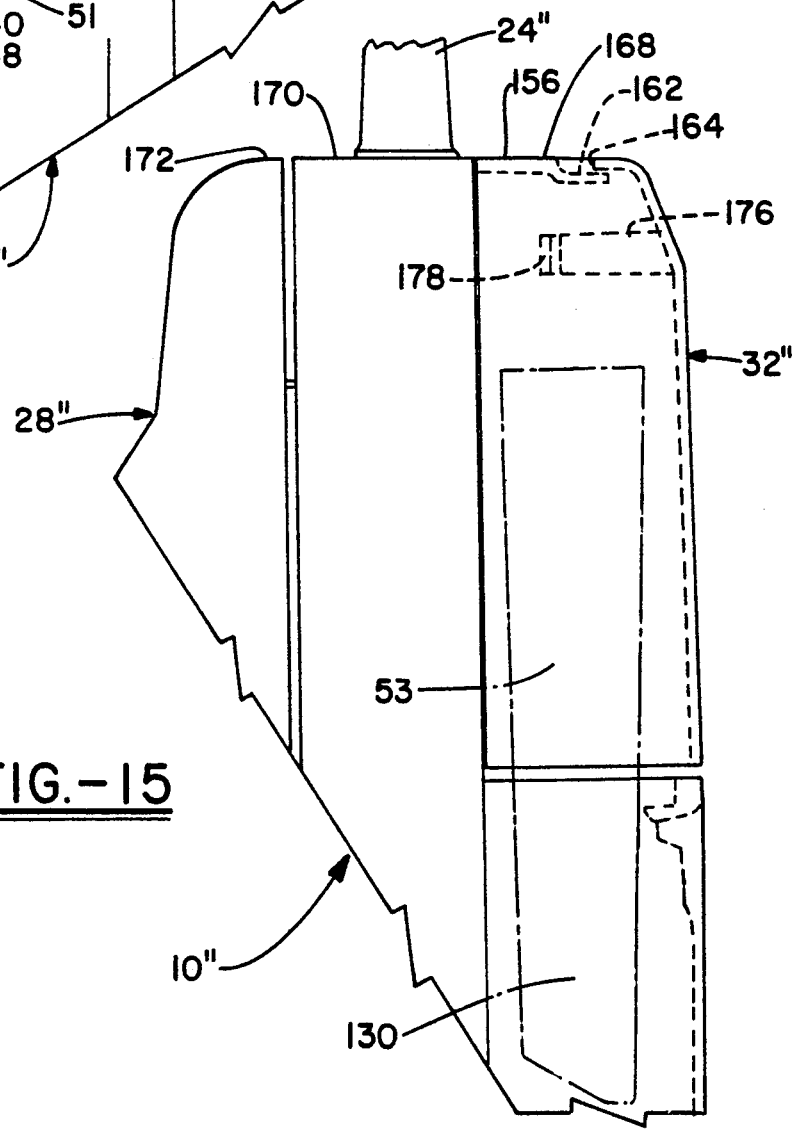
FIG. 15 is a side elevational view taken on line 15—15 of FIG. 13.

There is shown in FIGS. 1-7, a first embodiment of the invention which includes an upright cleaner 10 having a suction cleaning nozzle 12, pivoted conventionally to a hard bag 14 that forms the upper portion of upright cleaner 10. The hard bag 14 provides a retention volume (not shown) for mounting of the dirt collecting bag (not shown), as is conventional. The bag 14 may sidewardly mount a conversion hose 16, with this hose open to cleaner suction at a lower end 18 and seated, when not in use, at its upper wand end 20. This end is removably, telescopically received in a sealing bore 22. A supplementary wand 23 may also be stored with hard bag 14. A cleaner handle 24 which includes an integral hand grip 26 may be molded or the like with hard bag 14 to extend upwardly therefrom to be convenient to the grasp of a user.

Hard bag 14 includes a bag door 28 mounted conventionally at its bottom to pivot (not shown) outwardly to provide access to the bag (not shown) stored in hard bag 14. A bag door catch or latch 30 maintains the bag door 28 is closed condition. The bag door 28 carries at its upper part a tool door or lid 32 that is pivoted to the bag door, slightly above an edge 34 of it. This edge is displaced downwardly from a top surface 36 of bag door 28 a sufficient distance to permit space for tools to be stored in tool door or lid 32. A hinge 37 between bag door 28 and tool door or lid 32 provides for its pivoting, while a slight split 39 between the bag door 28 and tool door 32 permits this pivoting to be unobstructed. The bag door lid top surface 36 is flush or coplanar with a top surface 35 of hard bag 14 to provide a smooth continuous surface at this juncture. However, top surface 36 of bag door 28 is inset at the front of this top surface to provide an angled stepped portion 38 to permit abutting nesting of an edge 41 of the tool door 32 with the bag lid 28. This place a side surface 43 of tool door 32 flush with a side surface 40 of the bag door 28. A top surface 42 of tool door 32 is also flush with bag door lid top surface 36 and top surface 38 of hard bag 14. Thus, sides 40, 40 of tool door 32 overlap protruding portions of the bag door 28 slightly as does a top wall 44 of bag door lid 28.

The tool door or lid 32 is maintained in closed position by swinging of the tool door 32 upwardly on hinge 37, until it nests with stepped portion 38. In this position a downwardly depending tool door lid catch 48 engages in a latch aperture 50 in top surface 36 of bag door 28. The door lid catch 48 is integral with tool door 32 and also is of a somewhat resilient plastic material so it easily deforms to pass into aperture 50. A pair of finger engaging tabs 52, 52 integral with tool door 32 and extending upward from the top wall 44 of it permit deformable unlatching of the tool door lid catch 48 to permit downward swinging of tool door 32.

At least three cleaning tools can be easily mounted with the upright cleaner 10 by being nested conveniently within hard bag 14. In the first embodiment these tools are mounted in the tool door or lid 32 and may take the form of a dusting brush 49, a furniture nozzle 51 and a crevice tool 53. These tools are shown somewhat fragmentarily as to their mounting means within the door in FIG. 2 and illustrate a convenient mounting of the long and relatively thin crevice tool 53 somewhat to the side of the other two tools.

Turning specifically to FIGS. 3–7, it can be seen that a tool nesting section 54 is formed in the bag door 28 and a tool nesting section 56 is formed in the tool door lid 32 to form therebetween a tool cavity 55. The tool nesting section 54, in the bag door, essentially comprises contoured depressions or wells formed in a facing wall 58 of tool nesting section 54 of bag door 28 which permit insertion of approximately half the depth of each tool in these depressions. The dusting brush 49 has a well or depression 60, the furniture nozzle 51 has a well or depression 62 and the crevice tool 53 has a well or depression 64. As can be seen these wells or depressions, as is conventional, take an indented contour similar to the tool they mount so that the tools are loosely nested into the facing wall 58 of bag door 28 when the tool door or lid 32 within which they are fixedly mountedly carries the tools to a closed position of door 32.

The tools, themselves, are mounted in the tool door lid 32, primarily by the use of integral ribbing which resiliently deforms when the tools are insertedly mounted in the tool door 32. The furniture nozzle 51 is caught between two nubbed ribs 66, 68, integral with the tool door 32 and extending transversely to it and spaced apart for the wedging reception of a tubular end portion 70 of furniture nozzle 51. The dusting brush 49 is similarly wedgingly captured between two nubbed, spaced ribs 72, 74 at a tubular end portion 76 of it. The crevice tool 53 is similarly wedgingly captured between two nubbed spaced ribs 78, 80. The furniture nozzle 51 and wand 53 also rest on projections 82 and 84 extending inwardly from an internal surface 86 of tool door 32 while the dusting brush 49 also rests abuttingly against internal surface 86.

The depth of the tool nesting section 56 in tool door 32 is governed generally by the depth of its sides 40, 40 and the top surface 36. These are sized sufficiently deep to accommodate the tools (all seen in FIGS. 2 and 4). The tool door is completed by a front panel 90 which is integral with the sides 40, 40 and top 36 so that an open box shape is formed at the upper end of the hard bag 14 for user convenient nesting of the most frequently used cleaner tools.

The hinge 37 for the tool door 32 is formed by a pair of spaced, integral fixed pivot posts 92, 94, mounted with the bag door 28, that extend horizontally outwardly therefrom on its tool door side through the tool nesting section 54. These posts include aligned pivot apertures 96, 98 into which transversely extending pivot lugs 100, 102 of the tool door 32 are resiliently snapped. These pivot lugs are mounted on spaced, tool door pivot posts 104, 106 integral with the tool door 32 horizontally inwardly from it. One way wedge cams 108, 108 on the pivot lugs 100, 102 insure proper reception of them into pivot apertures 96, 98.

The pivoted swinging motion of tool door 32 is limited by a strap member 110 having a rigid, lodging cross bar 112 fixed to each of its ends. The cross bar, at each end of strap member 110, extends transversely beyond the width of strap member 110 and behind, a vertically and transversely extending tab member 114. This tab member maintains each cross bar 112 in a slot 116 open at a top side 118 for insertion of the cross bar 112 and its extending end of the strap member 110. The strap member 110 is extremely flexible so as to provide a folded version 111 as is necessary when the tool door 32 is in closed position. The strap member 110 is selected with sufficient strength to adequately support the tool door 32 and its tools 49, 51 and 53 when the tool door 32 is swung to open position as shown in FIG. 2 and FIG. 5.

The second embodiment is shown in FIGS. 8–12. In its description like elements to those in the first embodiment are given like numbers and changed element's numbers are primed.

There is shown in these Figures, an upright vacuum cleaner 10' having a hard bag 14' surmounted by a molded in handle 24 and integral hand grip 26. The hard bag 14' includes a bag door 28' hinged at its bottom (not shown) to the remainder of the hard bag 14' and removably fixed in a closed position by a bag door catch 30. A hose 16 may be stored on a side of the upright cleaner 10' to provide ease in conversion of this cleaner to a straight air hose mode. A supplemental wand 23 may also be stored on upright cleaner 10' along the same side.

A tool door 32' is hinged to back door lid 28' so as to be swingable as the tool door of the first embodiment, with an L-shaped spring catch 48 on the tool door engaging in a catch aperture 50 of the bag door 28' when the tool door is closed. Finger engaging tabs 52, 52 aid in opening the tool door 32' from its closed position.

Tool door 32' includes top surface 42' and vertical sides 40', 40' to form an inwardly and downwardly open cover for the tools which, in this embodiment, are mounted in the bag door 28'. These tools include a furniture nozzle 49, a dusting brush 51 and a crevice tool 53 which are covered by the tool door 32'. This door, as in the first embodiment, provides smooth top and side surfaces contiguous to like surfaces on the bag door 28' of the upright cleaner 10'. But in this instance an edge 119 of bag door 32' which extend around three of its sides, abut against a contiguous peripheral edge 120 of bag door 28'. Thus, the top surface 36' of bag door 28' is still planar with the top surface 42' of tool door 32' in its abutting position and the sides 40', 40' also planar the sides of the bag door.

The tools in this embodiment of the invention, as is seen, are not disposed in the tool door but in a tool tray 122 that is snap fit into the hard bag 14 by a series of four spaced locking barbs 124, 124, 124 and 124 which engage behind hooked over tabs 126, 126, 126, 126, integral with bag door 28'. The tool tray 122 includes wells 60' and 62' for nesting of dusting brush 49 and furniture nozzle 65, and nubbed ribs (not shown) similar, e.g., to the nubbed ribs 72, 74 in the first embodiment to maintain the dusting brush and furniture nozzle is nested position. The tool tray 122 could be made integral with the bag door 28'.

Crevice tool 53, in this embodiment of the invention, is disposed partially in a well 64' formed in tool tray 122 but extends vertically through an aperture 127 in a bottom side 128 of tool tray 122 so that its bottom end 130 is disposed in a depending shaped well 132 formed in bag door 28' and having the generally outline of the bottom end 130 of wand 53.

The tool door 32' is pivoted to bag door 28' by pivot lugs 100, 102, integral with the tool door 32', that extend transversely through pivot posts 92', 94', respectively, mounted integrally (not shown) with bag door 28'. These posts pass through post apertures 136, 137 in tool tray 122 to be connected (not shown) to the bag door, proper. A stop 139 of tool door 32' abuts bottom side 128 of tool tray 122 to limit swinging of tool door 32' downwardly.

There is shown in FIGS. 13–16 the preferred embodiment of the invention with similar elements to those shown in the first two embodiments double primed. This embodiment permits a handle 24'' to be a separate piece that can be mounted internally in the hard bag 14'' so that it must depend slightly downwardly in it. However, this embodiment of the invention still permits the mounting of the tools in upper reaches of the hard bag 14''.

A dirt bag door 28'', in this embodiment, is mounted on the rear side of the hard bag 14'' and hinged thereto in a conventional manner (not shown) at its bottom, while a tool door 32'' is hingedly mounted to a front side 134 of the hard bag 14''. This side of hard bag 14'' includes a shaped indent forming a handle 136 disposed immediately below the tool door 32''.

Tool door 32'' is hinged to hard bag 14'' by a living hinge 138 with one lower leaf 140 of this hinge held compressingly in a slot 142 in hard bag 14''. This mounts the hinge 138 to the hard bag 14''. Another vertical leaf 144 of living hinge 138 is mounted to tool door 32'' by an integral headed button 146 on a front panel 148 of tool door 32'' forcedly received in an aperture 150 in vertical leaf 144 of living hinge 138. The tool door 32'' is thereby manually urged to closed position through living hinge 138 but may be easily opened to gain egress to the dusting brush 49, furniture nozzle 51 and crevice tool 53.

The tool door 32'' is generally U-shaped in plan view and includes, along with a front panel 148, integral curved and angled side panels 152, 152 which abut with and merge with side panels 154, 154 of hard bag 14''. The tool door 32'' includes a top 156, which because of the U-shape of tool door 32'' (in plan view), is shorter in a middle portion 158 of it than in its extending side portions 160, 160. The top 156 of tool cover door 32'', includes along an inner U-shaped edge 164 which overlaps a vertically downwardly displaced inset 162 on hard bag 14'' also U-shaped. This provides a convenient finger hold arrangement for the user of upright cleaner 10'' to permit opening of the tool cover door 32''. The inner U-shaped edge 164 of top 156 is only slightly spaced from a forward terminating border 166 of hard bag 14'' to provide a closed shape for the upper portion of cleaner 10''. As can be seen a top surface 168 of top 156 of tool door 32'' and a top surface 170 of hard bag 14'' are generally coplanar except for the finger hold inset 162 on tool door 32''. Similarly, a top surface 172 of bag door 28'' is also generally coplanar with these two surfaces. Thus, a substantially continuous, smooth top surface is provided for the cleaner 10'', interrupted only by the inset 162 and a bezeled switch 174 utilized for energization of the upright cleaner 10''.

The tool cover door 32'' is latched to hard bag 14'' by a pair of inwardly extending integral latch pieces 176, 176 (only one shown) each having a conventional cam angled latching shoulder 178. These latches are inserted into rectangular bores 180, 180 formed by hollow horizontally extending rectangular, integral posts 182, 182 in hard bag 14'', with each of the latching shoulders 178 engaging (not shown) over the inner end of an inner wall 184, 184 of the posts 182, 182 in a conventional manner to mount the bag door 28'' against the hard bag 14''. These latches and their means for reception are located adjacent the top center of the tool door when the door is in closed position.

The handle 24'' is generally H-shaped (the H turned on its side) in elevation at its bottom mounting portion 186 to include horizontally extending upper and lower legs 188, 190 and thickened, vertical cross bar 192. The H-shaped bottom portion 186 is inserted in a similarly shaped channel 194, formed integrally in hard bag 14'' and opening rearwardly towards the bag door 28'' location for the insertion of handle 24''. A tab 196, also integral with hard bag 14'', mounts a screw 198 which fixedly maintains bottom mounting portion 186 of handle 24'' in assembled relationship. As can be seen this just described structure fixedly places the bottom mounting portion 186 of handle 26'' downwardly depending within upper portions of a tool cavity 55'' in the upper reaches of hard bag 14''.

The tool cavity 55" includes a well 60" for furniture nozzle 49, a well 62" for dusting brush 51 and well 64" for wand 53. As in the second embodiment, the bottom end 130 of crevice tool 53 extends downward into hard bag 14". As can be seen, the upper end of crevice tool 53 is disposed in its respective well very close to the lower termination of handle 24" while the dusting brush 51 and furniture nozzle 49 are placed so they vertically overlap, at their top, lower portions of handle 24". With this disposition of the three tools, with an inwardly jutting handle, valuable bag cavity space is conserved within hard bag 14". Still the tools are conveniently arrayed at the upper portion of hard bag 14" for ease in use by an operator of upright cleaner 10".

It should now be clear that the description of the structure of the foregoing three embodiments fully satisfies to all the objects of the invention set out in the beginning of this Specification. It should also be clear that many modifications could be made to the structure described which would still fall obviously within its spirit and tenor.

What is claimed is:

1. A tool storage arrangement for a hard bag cleaner including;

a) a handle extending upwardly from the top of a hard bag cleaner, b) said tool storage arrangement being disposed at least partially below said top of said hard bag cleaner adjacent said handle in a closed compartment in said hard bag cleaner, c) said closed compartment mounting cleaning tools therein, d) said tool storage arrangement including a movable door opening to expose a portion of said hard bag cleaner, e) said hard bag including a top surface, f) said movable door including a top surface, and g) said movable door top surface, in closed position, being generally aligned with said hard bag top surface.

2. A tool storage arrangement for a hard bag cleaner including;

a) a handle extending upwardly from the top of a hard bag cleaner, b) said tool storage arrangement being disposed at least partially below said top of said hard bag cleaner adjacent said handle in a closed compartment in said hard bag cleaner, c) said close compartment mounting cleaning tools therein, d) said tool storage arrangement including a movable door opening to expose a portion of said hard bag cleaner, e) said hard bag includes side surfaces, f) said movable door including side surfaces, and g) at least one of said movable door side surfaces being generally aligned with at least one of said hard bag side surfaces when said movable door is closed.

3. A tool storage arrangement for a hard bag cleaner including;

a) an upwardly extending hard bag portion, b) a suction nozzle attached to said hard bag portion adjacent its bottom, c) a handle extending upwardly from the top of said hard bag portion, d) said tool storage arrangement being disposed below said top of said hard bag portion adjacent said handle in a closed compartment in said hard bag cleaner, e) said closed compartment including a tool door, f) said tool door being movable to expose said closed compartment, and g) said movable door being limited in its movement by a strap connection.

4. A tool storage arrangement for a hard bag cleaner including;

a) an upwardly extending hard bag portion, b) a suction nozzle attached to said hard bag portion adjacent its bottom, c) a handle extending upwardly from the top of said hard bag portion, d) said tool storage arrangement being disposed below said top of said hard bag portion adjacent said handle in a closed compartment in said hard bag cleaner, e) said closed compartment including a tool door, f) said tool door being hinged to said hard bag portion, g) tools disposed in said closed compartment, h) said hard bag cleaner including a bag lid, and i) said tool storage arrangement being disposed at least partly in said bag lid.

5. A tool storage arrangement for a hard bag cleaner including;

a) a handle extending upwardly from the top of a hard bag cleaner, b) said tool storage arrangement being disposed at least partially below said top of said hard bag cleaner adjacent said handle in a closed compartment in said hard bag cleaner, c) said closed compartment mounting cleaning tools therein, said cleaning tools being disposed in said closed compartment in an upper position immediately below said top, d) said tool storage arrangement including a movable door opening to expose a portion of said hard bag cleaner, e) said handle of said hard bag cleaner extending partly within a hard bag of said hard bag cleaner, and f) at least one of said tools, in said upper position, disposed to extend in an overlapping vertical direction with at least a portion of said inwardly extending handle.

6. A tool storage arrangement for a hard bag cleaner including;

a) a handle extending upwardly from a bag of said hard bag cleaner, b) said tool storage arrangement being disposed below said top of said hard bag cleaner in a closed compartment in said hard bag cleaner, c) said tool storage arrangement mounting cleaning tools therein, d) said tool storage arrangement including a movable door, e) said hard bag cleaner including a bag lid, and f) said tools mounted in said movable door, said movable door covering a cavity in said bag lid receiving jutting portions of said tools.

7. A tool storage arrangement for a hard bag cleaner including;

a) a handle extending upwardly from the top of said hard bag cleaner, b) said tool storage arrangement being disposed below said top of said hard bag cleaner in a closed compartment in said hard bag cleaner, c) said tools of said tool storage arrangement include a crevice tool member and at least one nozzle member, d) said crevice tool member disposed adjacent to said at least one nozzle member when in said arrangement, and e) said crevice tool also disposed in a well extending below a compartment mounting the remainder of said tools of said tool storage arrangement.

8. A tool storage arrangement for a cleaner having a hard housing portion including;

a) said hard housing portion extending upwardly, b) a suction nozzle attached to said hard housing portion adjacent its bottom, c) a handle extending upwardly from the top of said hard housing portion, d) said hard housing portion having at least one face having a generally vertical, continuous planar extent from top to bottom, e) said tool storage arrangement being disposed below said top of said hard housing portion adjacent said handle in a closed compartment in said hard housing portion cleaner, f) said closed compartment being wholly sequestered from the remainder of a dirt receiving cavity formed by said hard housing portion by a generally vertically extending partition forming a wholly inwardly displaced inside wall of said closed compartment, wholly inwardly displaced from said generally vertical planar extent, g) said closed compartment including a tool door, h) said tool door being hinged to said hard housing portion on a horizontal axis spaced substantially above said suction nozzle to extend, in closed position, in a facing relationship to said vertically extending partition, i) tools disposed in said closed compartment between said closed tool door and said vertically extending partition, j) said tool door having at least a front, a top edge wall and side edge walls, k) said top edge wall and said side edge walls, when said door is closed, extending at least partly inwardly beyond said hard housing portion face having a generally vertical continuous planar extent so that the said edge walls are substantially flush with the portions of the housing surface forming the opening closed by said door so that the entire periphery of said door is substantially flush, with said housing and l) said tool swinging downwardly on said horizontal axis to an open position whereby said tools are readily accessible from the front of said compartment of said hard housing portion.

9. The tool storage arrangement for a hard housing cleaner as set out in claim 8 wherein;

a) said movable door is pivoted for movement relative to said hard housing portion of said hard housing cleaner by cam angled pivot lugs.

10. The tool storage arrangement for an upright vacuum cleaner as set out in claim 8 wherein;

a) said latch means is at the top and medially disposed relative to the width of said door.

* * * * *